US006742230B2

(12) United States Patent
Choi

(10) Patent No.: US 6,742,230 B2
(45) Date of Patent: Jun. 1, 2004

(54) SYSTEM AND METHOD FOR SNAP STUD

(75) Inventor: Chi Ming Choi, Hong Kong (CN)

(73) Assignee: Ching Fung Apparel Accessories Co. Ltd., Kowloon (HK)

( * ) Notice: Subject to any disclaimer, the term of this patent is extended or adjusted under 35 U.S.C. 154(b) by 5 days.

(21) Appl. No.: 10/206,405

(22) Filed: Jul. 26, 2002

(65) Prior Publication Data

US 2004/0016086 A1 Jan. 29, 2004

(51) Int. Cl.[7] ..... A44B 1/18
(52) U.S. Cl. ..... 24/691; 24/95
(58) Field of Search ..... 24/94, 95, 103, 24/101 R, 101 B, 687, 688, 689, 690, 691; 411/362; 27/432, 512, 798

(56) References Cited

U.S. PATENT DOCUMENTS 1,872,968 A * 8/1932 Kimball ..... 24/691
1,897,936 A * 2/1933 Hausner ..... 24/691
1,943,063 A * 1/1934 Fenton ..... 24/95
1,965,115 A * 7/1934 Fenton ..... 24/691
2,071,507 A * 2/1937 Dews ..... 29/432.1
2,188,443 A * 1/1940 Purinton ..... 24/95
5,647,105 A * 7/1997 Candotti ..... 24/691

* cited by examiner

*Primary Examiner*—Robert J. Sandy
(74) *Attorney, Agent, or Firm*—Seed IP Law Group PLLC

(57) ABSTRACT

A stud snap system includes a pin, a receiver, and a stud. The receiver fixedly engages with the pin and also fixedly engages with the stud to attach of the stud snap system to a material. The material can include apparel, clothing, sportswear, outdoor gear, fabrics, coverings, and textiles. Use of the receiver affords a large selection of options for materials and geometries to be used for the stud since the pin is not directly engaged with the stud.

7 Claims, 4 Drawing Sheets

SYSTEM AND METHOD FOR SNAP STUD

BACKGROUND OF THE INVENTION

1. Field of the Invention

The present invention relates to apparel fasteners, and more particularly, to snap type fasteners.

2. Description of the Related Art

Related-art fasteners for material, such as apparel, clothing, sportswear, outdoor gear, fabrics, coverings, textiles, and so on include, snaps. Snaps generally include a stud and a portion to receive the stud and thereby fasten material.

The inventor named herein ("inventor") has noticed deficiencies and/or unmet needs associated with related-art snap studs, a few of which will now be set forth (other related-art deficiencies and/or unmet needs will become apparent in the detailed description below).

The inventor has discovered that it would be advantageous for a snap stud to be attached to material without a requirement of first producing a hole in the material prior to attachment of the snap stud. The inventor has discovered that attachment of related-art snap studs to material conversely requires a hole to be first made in the material before one of the related-art snap studs is attached to the material. The inventor has thus recognized that a need exists in the art for snap studs that can be attached to material without need of first making a hole in the material prior to attachment of the snap stud.

The inventor has discovered that it would be advantageous for a snap stud to have an outside surface that is substantially unaffected as to how the snap stud is attached to the material. The inventor has discovered that attachment of related-art snap studs can affect one or more outside surfaces and consequently, the relative appearance of the snap studs. The inventor has thus recognized that a need exists in the art for a snap stud that can be attached to material without being substantially affected by how the snap stud is attached to the material.

The foregoing-described inventor discoveries constitute at least a part of the inventive content herein.

BRIEF SUMMARY OF THE INVENTION

In one embodiment, a system includes but is not limited to: a pin including a shaft portion and a head portion, the shaft portion including a first end portion, a second end portion, and a longitudinal length, the head portion being adjacent the first end portion of the shaft portion, the second end portion of the shaft portion including a tip portion that is substantially pointed to pierce a material when the pin is in an unaltered state and that is substantially blunt when the pin is in an altered state; a receiver including a pin enclosure portion and a backing portion, the pin enclosure portion having first and second end portions, the first end portion having an opening and the second end portion being enclosed by a top portion, the opening so sized to receive the shaft portion of the pin, the pin enclosure portion having a longitudinal axis, the top portion of the receiver having a hardness so selected to change the pin from the unaltered state to the altered state when the tip portion of the pin is forced against the top portion, the top portion having a protrusion portion, the top portion so shaped that the protrusion portion moves from an un-extended position to an extended position in one or more directions away from the longitudinal axis of the pin enclosure portion when the pin is forced against the top portion and changed from the unaltered state to the altered state; and a stud including a stud top portion and a backing enclosure portion, the stud top portion having an opening so sized to receive the pin enclosure portion when its protrusion portion is in the un-extended position, the stud top portion having an internal surface so sized to fixedly engage with the pin enclosure portion when the protrusion portion is in the extended position, the backing enclosure portion so sized and positioned with respect to the stud top portion to receive the backing portion of the receiver when the stud top portion has received at least a portion of the pin enclosure portion of the receiver.

The foregoing is a summary and thus contains, by necessity, simplifications, generalizations and omissions of detail; consequently, those skilled in the art will appreciate that the summary is illustrative only and is NOT intended to be in any way limiting. Other aspects, inventive features, and advantages of the devices and/or processes described herein, as defined solely by the claims, will become apparent in the non-limiting detailed description set forth herein.

BRIEF DESCRIPTION OF THE SEVERAL VIEWS OF THE DRAWING(S)

Implementations will now be described, by way of example only, by referring to the annexed drawings, wherein:

FIG. 1 is an isometric representation of a snap stud system prior to assembly.

FIG. 2 a cross-sectional representation of a snap stud system prior to assembly.

The use of the same symbols in different drawings typically indicates similar or identical items

DETAILED DESCRIPTION OF THE INVENTION

Figure 1:
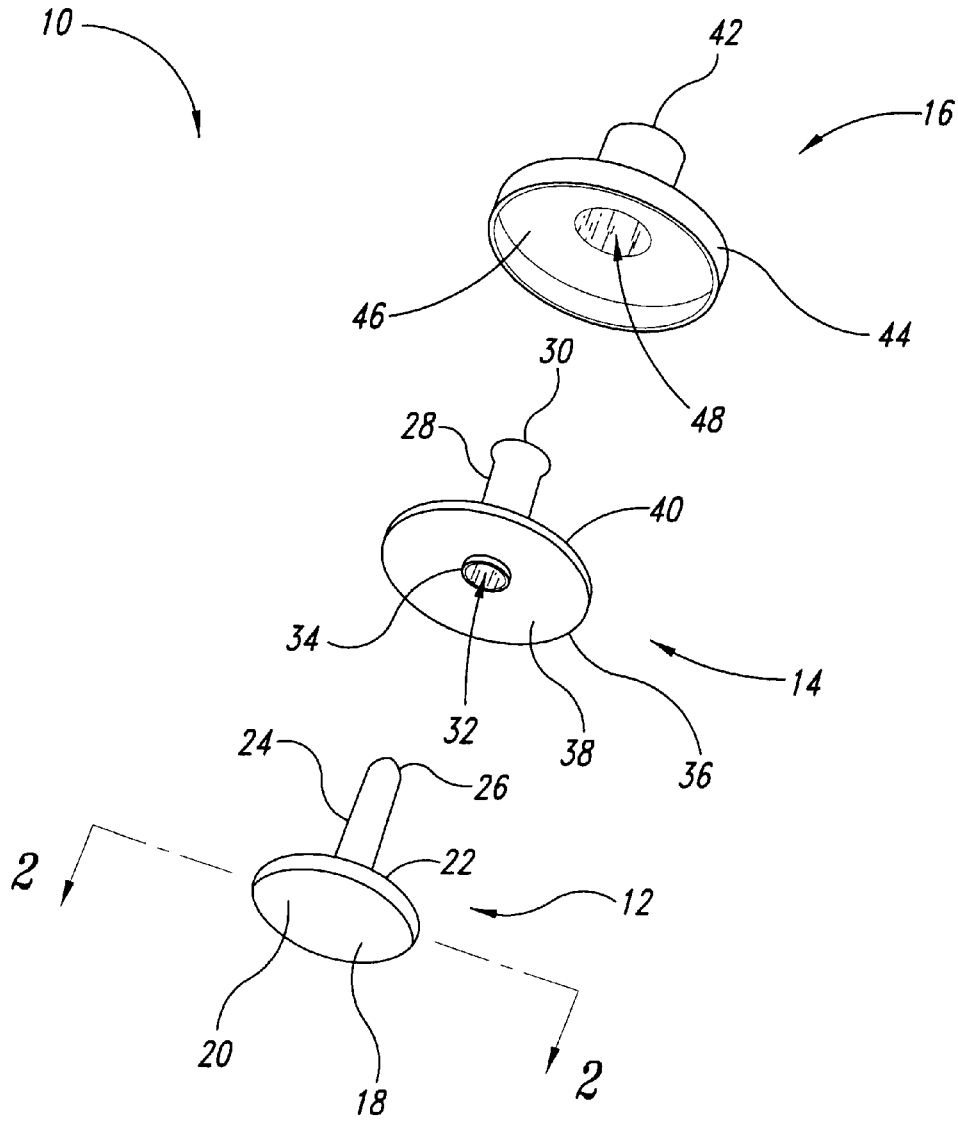

An isometric representation of a disassembled snap stud system is included as FIG. 1. Depicted is a snap stud system 10, in a disassembled state and prior to first assembly, composed of three distinct parts: a pin 12, a receiver 14, and a stud 16. The pin 12 has a head 18, with an exterior surface 20 and an interior surface 22, and has a shaft 24 with a tip 26. The receiver 14 has a pin enclosure 28, with a top 30, an opening 32, and a lip 34, and has a backing 36, with an interior surface 38 and an exterior surface 40. The enclosure 28 of the receiver 14 is so sized in diameter to closely receive the shaft 24 of the pin 12. However, as will be described further below, the length of the shaft 24 is greater than the interior height of the enclosure 28. The stud 16 has a stud top 42 and a backing enclosure 44, with an interior surface 46, and an opening 48. The backing enclosure 44 of the stud 16 is so sized in diameter to closely receive the backing 36 of the receiver 14.

Figure 2:
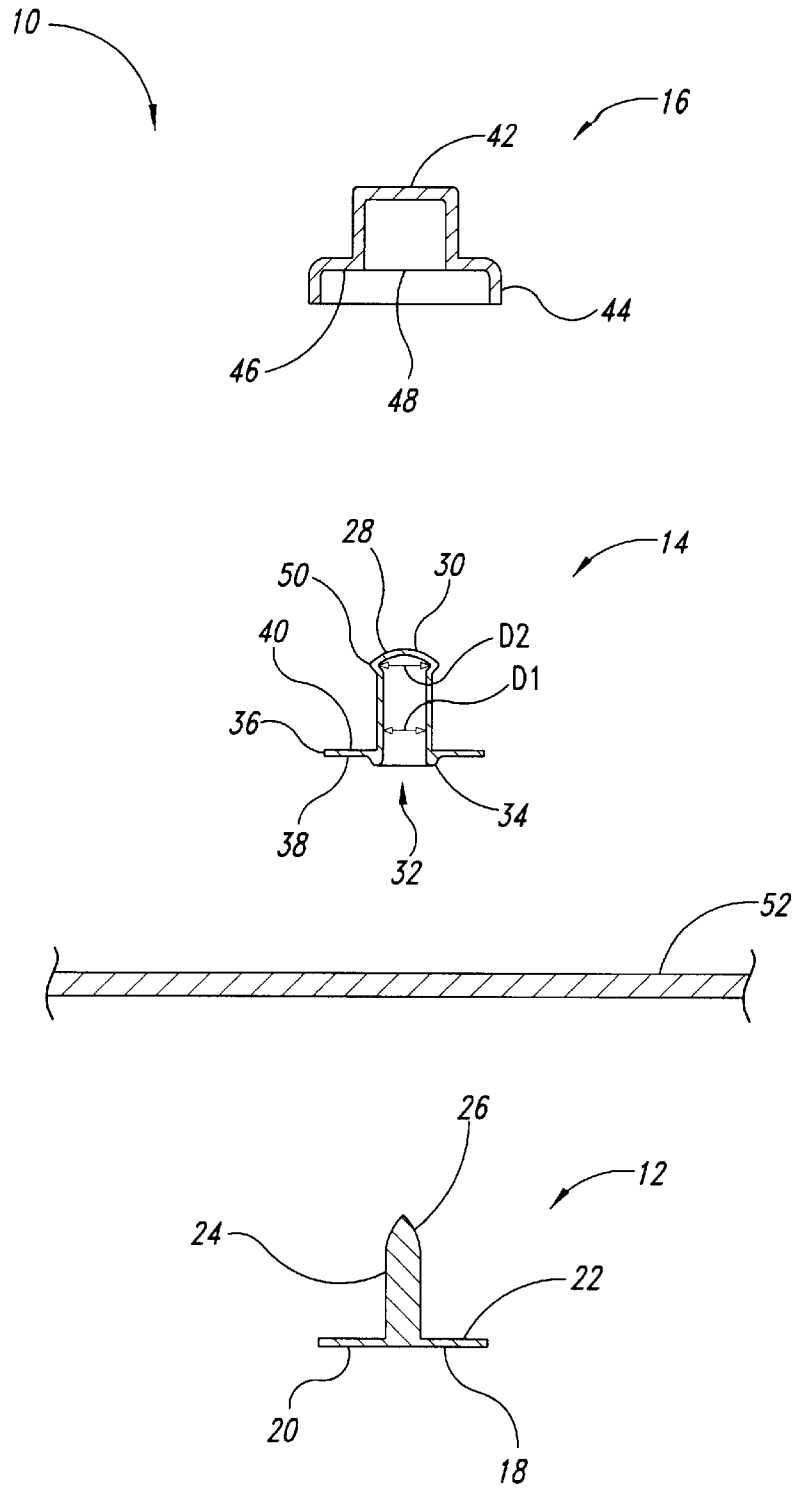

With reference now to FIG. 2, depicted is a cross-sectional representation of the snap stud system 10, in a disassembled state prior to first assembly. Further shown are protrusions 50 of the pin enclosure 28 of the receiver 14. The pin enclosure 28 has a first inner diameter, D1, which is greater than the outer diameter of the shaft 24 of the pin 12 allowing for the pin to be received inwardly by the pin enclosure. Near the area of the protrusions 50, the pin enclosure 28 has a second inner diameter, D2, greater than the first inner diameter, D1. The second inner diameter, D2, allows for reshaping of the malleable or deformable tip 26 of the pin 12 as the pin is driven against the top 30 of the pin enclosure 28 during attachment of the snap stud system 10 to a material 52, described in further detail below.

Figure 3:
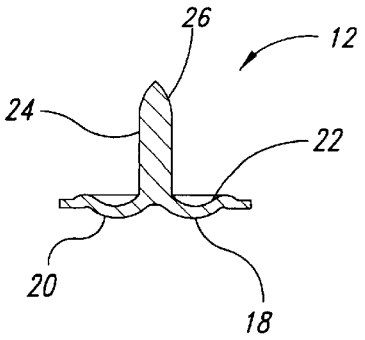
FIG. 3 is a cross-sectional representation of a second embodiment of pin 12.

Also shown in FIG. 2, is a cross-sectional representation of the pin 12 in which the surface 20 of the head 18 possesses a uniformly flat structure. An alternative implementation of the head 18 of the pin 12 is depicted in FIG. 3 in which the surface 20 of the head includes curved portions.

Figure 4B:
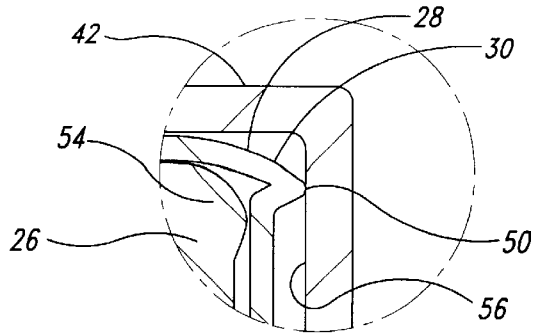
FIGS. 4A and 4B are cross-sectional representations of an assembled snap stud system.
Figure 4A:
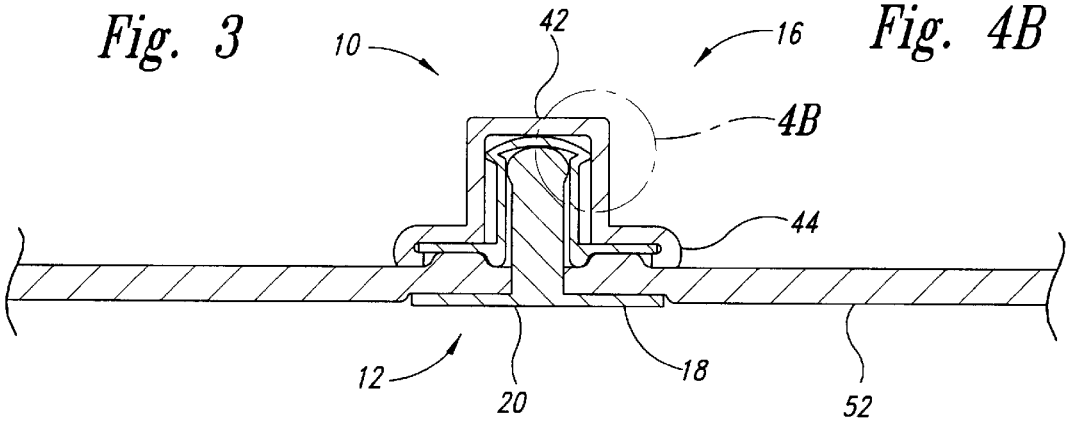
Figure 5:
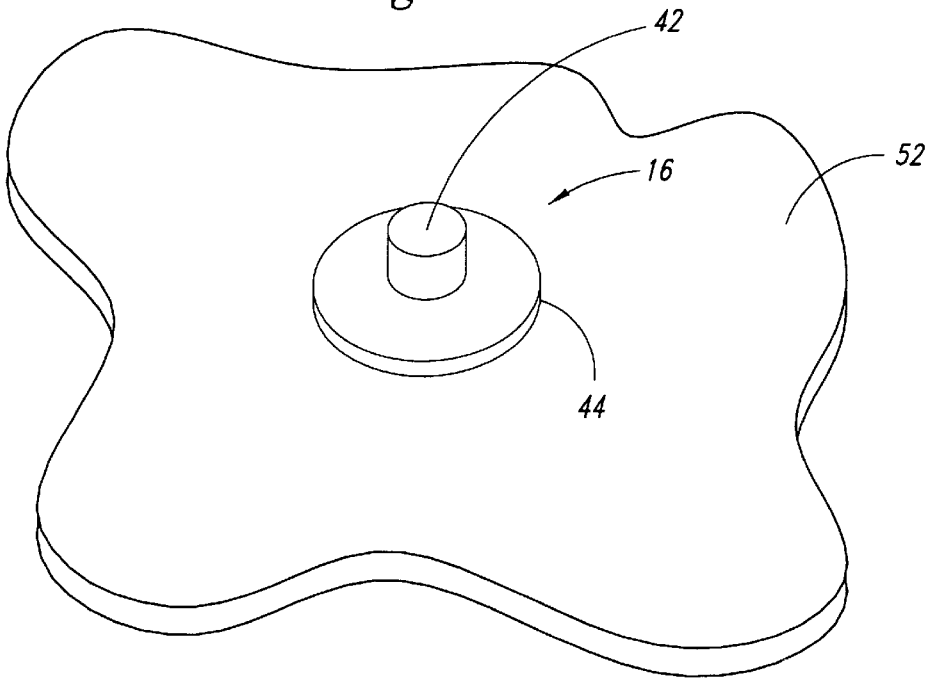
FIG. 5 is an isometric representation of stud 16.
Figure 6:
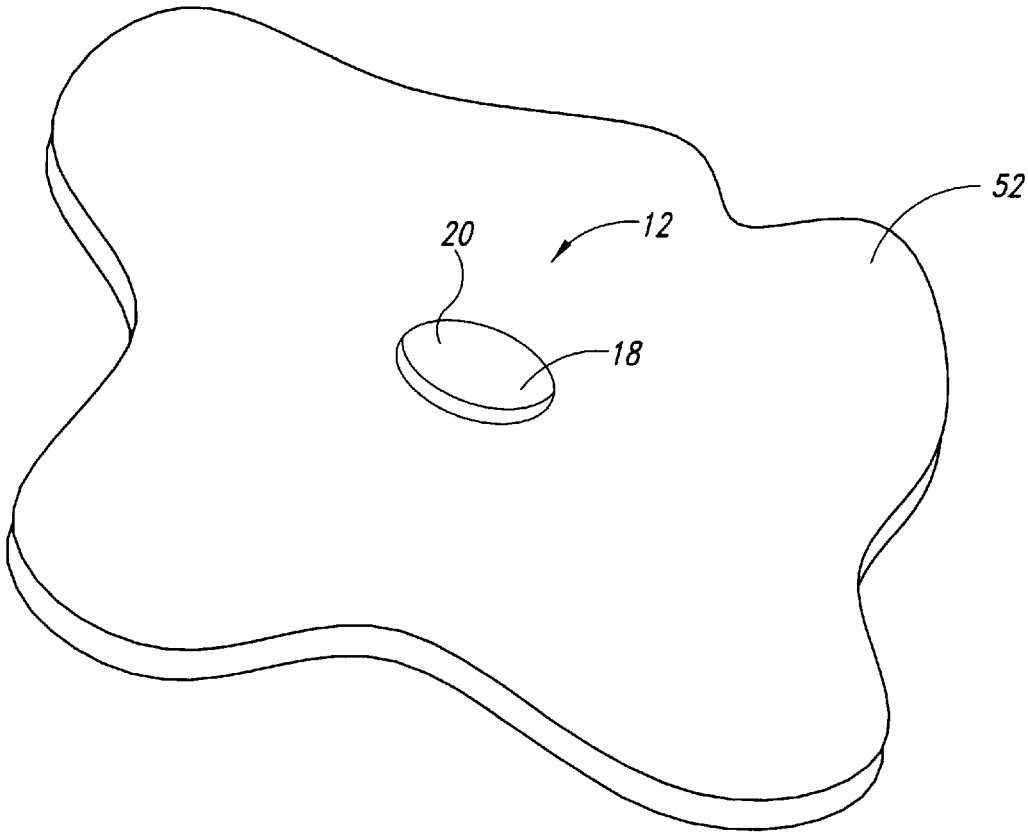
FIG. 6 is an isometric representation of pin 12.

As to FIGS. 4A and 4B, depicted are cross-sectional representations of the snap stud system 10 in an assembled condition and attached to the material 52. As shown, the backing enclosure 44 is crimped along all or part of its perimeter in to retain the receiver 14 inside of the stud 16. Also shown, attachment of the snap stud system 10 to the material 52 causes some compression of the material between the head 18 of the pin 12 and the backing 36 of the receiver 14.

The length of the shaft 24 of the pin 12 is greater than the combined length of the interior height of the pin enclosure 28 and the compressed thickness of the material 52. Consequently, shaft length is shortened when the snap stud system 10 is attached to the material. When the pin 12 is in an un-altered state, the tip 26 of the pin 12 is sharp enough to pierce the material 52 during attachment of the snap stud system 10 to the material. This alleviates the need for using a separate step to make a hole in the material 52 before the snap stud system in affixed to the material.

To attach the snap stud system 10 to the material 52, the pin 12 is first pushed through the material and along the interior length of the pin enclosure 14, by applying pressure to the exterior surface 20 of the head 18 of the pin, until the tip 26 reaches the inner surface of the top 30. At this point, continued pressure is applied to the exterior surface 20 of the head 18 of the pin 12 to alter the state of the pin. Since the material hardness of the top 30 is preferably greater than the material hardness of the tip 26 of the pin 12, the tip is re-shaped to become a blunt end 54 having a diameter greater than the rest of the shaft 24 and expanding toward and forcing against the protrusions 50. The pin 12 is thereby fixedly coupled with the pin enclosure 14 through mechanisms such as frictional engagement (shown in FIG. 4B) or an interference fit (not shown) of the blunt end 54 with the pin enclosure 14. In turn, the protrusions 50 expand away from the longitudinal axis of the pin 12 and are forced against the interior surface 56 of the stud top 42 thereby fixedly coupling the pin enclosure 14 with the stud 16 resulting in the stud being fixedly coupled to the material 52.

Since the top 30 is hard enough to re-shape the tip 26 of the pin 12 rather than allowing the pin through the top, the material hardness of the stud top 42 need not be greater than the material hardness of the tip of the pin. Consequently the stud 16, including the stud top 42, could be made out of materials other than metal and could have a lower material hardness rating than that of the tip 26 of the pin 12. For instance, the stud 16 could be made out of a plastic, a nylon, or a soft metal, such as a high karat gold alloy (for instance, greater than 22 karat), or other relatively soft material. Alternatively, the stud 16 could be made out of a harder material, such as a metal, with a hardness greater than the hardness of the tip 26.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A system comprising:

a pin including a shaft portion and a head portion, the shaft portion including a first end portion, a second end portion, and a longitudinal length, the head portion being adjacent the first end portion of the shaft portion, the second end portion of the shaft portion including a tip portion that is substantially pointed to pierce a material when the pin is in an unaltered state and that is substantially blunt when the pin is in an altered state;

a receiver including a pin enclosure portion and a backing portion, the pin enclosure portion having first and second end portions, the first end portion having an opening and the second end portion being enclosed by a top portion, the opening so sized to receive the shaft portion of the pin, the pin enclosure portion having a longitudinal axis, the top portion of the receiver having a hardness so selected to change the pin from the unaltered state to the altered state when the tip portion of the pin is forced against the top portion, the top portion having a protrusion portion, the top portion so shaped that the protrusion portion moves from an un-extended position to an extended position in one or more directions away from the longitudinal axis of the pin enclosure portion when the pin is forced against the top portion and changed from the unaltered state to the altered state; and a stud including a stud top portion and a backing enclosure portion, the stud top portion having an opening so sized to receive the pin enclosure portion when its protrusion portion is in the un-extended position, the stud top portion having an internal surface so sized to fixedly engage with the pin enclosure portion when the protrusion portion is in the extended position, the backing enclosure portion so sized and positioned with respect to the stud top portion to receive the backing portion of the receiver when the stud top portion has received at least a portion of the pin enclosure portion of the receiver.

2. The system of claim 1 wherein the longitudinal length of the shaft portion of the pin in the un-altered state is greater than a combined length of an interior height of the pin enclosure portion and a compressed thickness of the material.

3. The system of claim 1 wherein the material is selected from apparel, clothing, sportswear, outdoor gear, fabrics, coverings, and textiles.

4. The system of claim 1 wherein a first part of the pin enclosure portion has a first inner diameter, a second part of the pin enclosure portion has a second inner diameter, and the shaft portion of the pin has an outer diameter, the first inner diameter being greater than the outer diameter, the second inner diameter being greater than the first inner diameter, the second inner diameter so sized to allow for change of the pin from the un-altered state to the altered state.

5. The system of claim 1 wherein the head portion has a surface with a uniformly flat structure.

6. The system of claim 1 wherein the stud top portion has a hardness less than the hardness of the tip portion of the pin and is made from one of the following: a plastic, a nylon, and a soft metal.

7. A system comprising:

a pin including a tip portion that is substantially pointed when the pin is in an unaltered state and is substantially blunt in an altered state, the tip portion having a first hardness;

a receiver including a pin enclosure portion having an opening so sized to receive the pin and having a top portion with a second hardness greater than the first hardness, the top portion having a protrusion portion and so shaped that the protrusion portion moves from an un-extended position to an extended position when the pin is forced against the top portion and changed from the unaltered state to the altered state; and a stud including a stud top portion having an opening so sized to receive the pin enclosure portion of the receiver when the protrusion portion of the receiver is in the un-extended position, the stud top portion having an internal surface so sized that the protrusion portion of the receiver fixedly engages a portion of the internal surface when the pin enclosure portion of the receiver is inside the stud top portion and the protrusion portion of the receiver is in the extended position.

* * * * *